United States Patent [19]

Hallinger et al.

[11] 4,379,677

[45] Apr. 12, 1983

[54] DEVICE FOR ADJUSTING THE CLEARANCE BETWEEN MOVING TURBINE BLADES AND THE TURBINE RING

[75] Inventors: Claude C. Hallinger; Robert Kervistin, both of Le mee sur Seine, France

[73] Assignee: Societe Nationale d'Etude et de Construction de Moteurs d'Aviation, "S.N.E.C.M.A.", Paris, France

[21] Appl. No.: 194,890

[22] Filed: Oct. 7, 1980

[30] Foreign Application Priority Data

Oct. 9, 1979 [FR] France ..... 79 25028

[51] Int. Cl.[3] ..... F01D 11/00; F01D 11/08

[52] U.S. Cl. ..... 415/175; 415/116; 415/138; 415/180

[58] Field of Search ..... 415/110, 116, 138, 175, 415/176, 180

[56] References Cited

U.S. PATENT DOCUMENTS

| | | | |
|---|---|---|---|
| 1,928,504 | 9/1933 | Schaper | 415/116 |
| 2,474,258 | 6/1949 | Kroon | 415/175 |
| 3,561,884 | 2/1971 | Zerlauth | 415/116 |
| 3,864,056 | 2/1975 | Gabriel et al. | 415/116 X |
| 4,222,707 | 9/1980 | Drouet et al. | 415/116 |
| 4,317,646 | 3/1982 | Steel et al. | 415/116 |

FOREIGN PATENT DOCUMENTS

| | | | |
|---|---|---|---|
| 1330892 | 9/1973 | United Kingdom | 415/116 |
| 2025536 | 1/1980 | United Kingdom | 415/116 |

*Primary Examiner*—Everette A. Powell, Jr.
*Assistant Examiner*—Frankie L. Stinson
*Attorney, Agent, or Firm*—Oblon, Fisher, Spivak, McClelland & Maier

[57] ABSTRACT

A device for adjusting the clearance between moving blades and the ring of a turbine wherein the ring includes a cylindrical sleeve, a perforated partition, and a wall, which together form an enclosure. Boreholes receive tubular elements which fit together with coaxial boreholes provided in opposite walls of a distribution chamber. The chamber communicates with pipes which admit heat regulating air. Alternating tubular elements traverse the perforated wall and the chamber to evacuate exhaust gas through pipes.

8 Claims, 3 Drawing Figures

DEVICE FOR ADJUSTING THE CLEARANCE BETWEEN MOVING TURBINE BLADES AND THE TURBINE RING

BACKGROUND OF THE INVENTION

1. Field of the Invention

The invention concerns a device for adjusting the clearance between the moving blades and the ring of a turbine and is designed to maintain a reduced and essentially constant clearance during changes in turbine speed, with such device including an inner sleeve having a seal, a perforated, cylindrical partition encompassing the sleeve, and an outer sleeve defining an enclosure which receives the air intended to heat or cool the ring after passing through the perforated partition.

2. Description of the Prior Art

The efficiency of a turbine is a function of a number of parameters, particularly the clearance existing between the tips of the blades and the stator. This clearance is set during construction at a given low value, and in order to avoid accidental rubbing during rotation, the turbine ring is generally provided with a seal made of abradable material which allows for non-destructive contact with the blades. Such rubbing results from differences in thermic expansion between the turbine disks and blades on the one hand and the housing which supports the ring on the other. The clearance provided in construction thus varies with the rapid changes in speed and temperature of the turbine.

In the starting and acceleration phases, the turbine blades and ring heat up more quickly than the disk, which produces an expansion of the ring and an increase in the clearance between the blades and the ring. In the deceleration phase, the blades and ring cool more quickly than the disk and clearance is minimal, with the risk of interference between blades and ring. In order to minimize, if not eliminate, variations in clearance, manufacturers have sought to made dimensional variations of the rotor and stator simultaneous through the selection of material expansion coefficients and through control of the temperature of the ring or of the structure which supports it.

To this end, French Pat. No. 2,064,889 describes a seal ring held in place by an annular support. This support communicates with pressurized air from the compressor and includes a flange having a large thermic mass. Passages provided in the wall of the support direct air toward the flange into a chamber which is also closed by a perforated wall. This perforated wall forms a second chamber in conjunction with the wall of the ring. The pressurized air serves to heat or cool the ring support. Then the same air is used to heat or cool the ring itself through the formation of jets across the perforated wall of the second chamber, ensuring a high speed of heat transfer between the air and the ring. Because the ring is segmented and held in place by flanges disposed at its two ends, the risk of non-simultaneous expansion of the extreme parts is not excluded. The connections between the segments and supports do not provide a suitable seal and the escape of gas makes temperature control difficult. Furthermore, mechanical assembly is complicated, which has the consequence of causing relatively long down-times during repair of the ring.

French Pat. No. 2,293,594 describes a device in which the seal ring, consisting of segments comprising protrusions and flanges, is held by an annular element supported by studs fastened at their outer end in holes provided in the envelope. This annular element includes holes enabling the passage of high pressure air from the compressor. A second annular element, having a greater mass than the first, is insulated from the high-pressure air by a screen. During speed variations, the second solid annular element, protected by the screen, expands or contracts less quickly than the first, thus enabling control of the expansion of the ring support and consequently the maintenance of clearance. The drawbacks of this construction are essentially the same as those pointed out for the first patent cited.

SUMMARY OF THE INVENTION

The invention is intended to produce a device in which the escape of cooling or heating air is perfectly determined. In addition, the ring support and air-intake chambers form a leak-tight assembly connected by a single element which simultaneously provides for the passage of air and for connection to the housing, as well as providing precise guiding. According to another particularity, heating or cooling air arrives directly to the entrance of the chambers.

According to the invention, the device for adjustment of the clearance between the blades and monobloc ring of a turbine, including an inner sleeve having a seal, a perforated cylindrical partition encompassing the sleeve and fastened to it, and a peripheral wall delimiting a chamber for distributing the air for heating and cooling the ring, is notable in that it includes tubular elements which radially connect an enclosure to the distribution chamber and ensure passage of heating or cooling air from the distribution chamber to the enclosure, with the enclosure being formed by the inner sleeve which supports the seal and by the opposite wall having boreholes which receive one end of the tubular elements.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
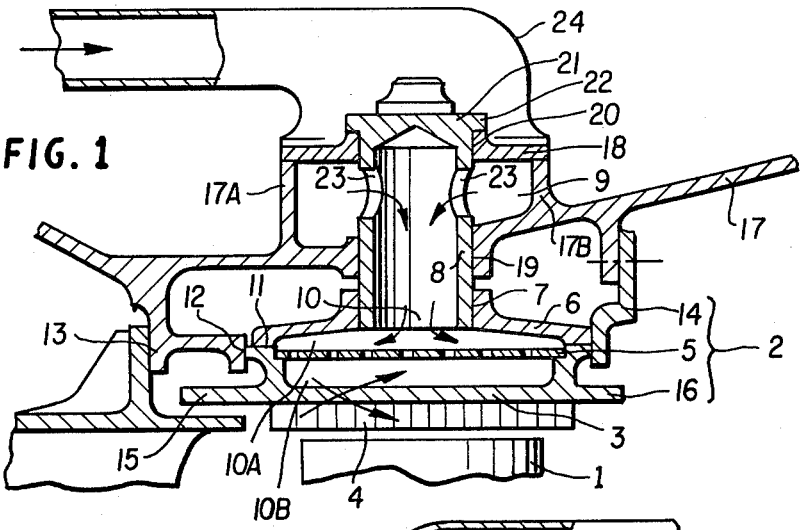
FIG. 1 is a longitudinal partial cross-section of turbine part comprising an embodiment of the device of the invention, showing the air intake.

FIG. 1 represents a longitudinal partial cross-section of the turbo-jet part which constitutes the turbine. Blades 1 are mounted in known fashion upon the rotor (not shown) and are struck by the flow of hot gas from the combustion chamber. The turbine is coupled to the compressor which supplies air to the combustion chamber and to the various cooling devices of the jet. Opposite moving blades 1 is mounted a device 2 for adjusting the clearance between the blades and ring of the turbine. Proceeding from the center of the jet to the periphery, this device includes a turbine ring consisting of a cylindrical sleeve 3 onto which is fastened a material 4 capable of being at least partially worn by the tips of the blades in the course of accidental expansions or vibrations, said ring constituting a monobloc seal ring; a perforated, cylindrical partition 5; and a wall 6 having boreholes 7. The device further includes tubular elements 8 and a distribution chamber 9. The tubular elements cooperate at one end with wall 6 and at the other end with distribution chamber 9.

Perforated partition 5 divides enclosure 10 formed by sleeve 3 and wall 6 into two chambers 10A and 10B. Chamber 10A receives cooling or heating air from distribution chamber 9 and distributes it over perforated partition 5 where it is divided into jets. These jets enter chamber 10B where they strike the back of the sleeve supporting the seal material, thus enabling a quick and effective heat exchange. The air which enters chamber 10B is then evacuated by means which will be described below.

The elements forming enclosure 10 are welded at 11, and the outer flanges 12 of sleeve 3 lie in planes which are perpendicular to the turbo-jet axis and slide in conjunction with stationary annular guide 13 and detachable annular guide 14. Guides 13 and 14 ensure that the ring is longitudinally centered. Wings 15 and 16 of the sleeve are intended to maintain the aerodynamic continuity of the housing.

Distribution chamber 9 consists at least in part of turbine housing 17, on which wings 17A and 17B are provided, such wings being essentially parallel to a plane which is perpendicular to the turbine axis, and of peripheral wall 18, which is fastened to the ends of the wings. The part of housing 17 on which guide 14 rests includes a scalloping for passage of the ring during assembly. The wall formed by housing 17 and wall 18 has coaxial boreholes 19 and 20 which serve to fasten and guide tubular elements 8.

According to the embodiment shown, the tubular element is closed by a base 21 having a peripheral flange 22 which enables the element to be fastened to chamber 9. Element 8 has openings 23 which allow air to pass through. The middle part of the element works in conjunction with borehole 19 provided in the chamber wall as to be able to move radially. The end of element 8 penetrates borehole 7 of enclosure 10 and forms a guide in the event of size variations in the ring. Because the boreholes are extended to form bushings, the contact surfaces between the hollow bodies and the boreholes are relatively great and simultaneously provide good guidance and an appropriate seal between the various elements, resulting in a precise control of temperature. Distribution chamber 9 is connected, according to the embodiment shown, to pipes 24 which supply heating and cooling air. This air may be selectively taken from cold or hot zones and at low or high pressures from compressors and even directly from outside the housing. The flow of air and its temperature may be controlled by an expandable ring similar to that described in French Pat. No. 2,280,791.

Figure 2:
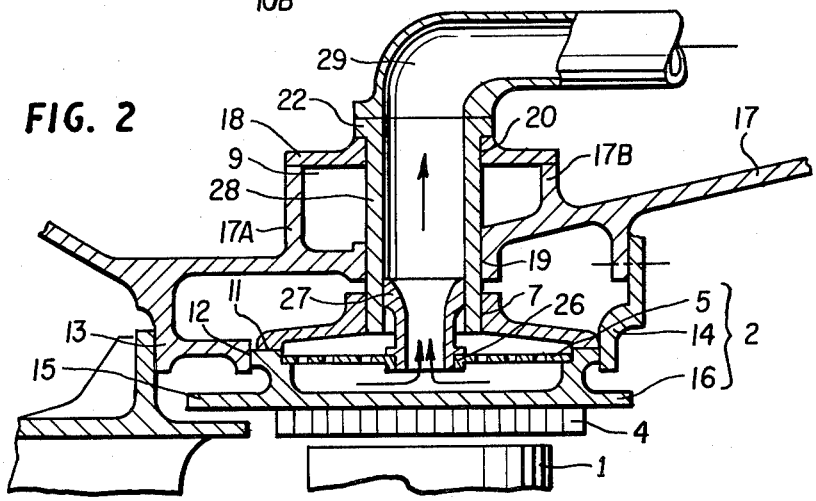
FIG. 2 is a longitudinal partial cross-section of the device according to one embodiment of the invention and representing air evacuation.

Construction of an exhaust, as shown in FIG. 2, enables the use of a cooling or heating fluid which is completely separate from the exhaust gas jet and has perfectly defined pressure and temperature characteristics.

This arrangement dispenses with the need to supply high-pressure air, facilitates temperature control in all cases, and yields a considerable gain in efficiency.

Within the perforated wall separating enclosure 10 into two chambers is provided an opening 26 which seats a nozzle 27 forming part of a tubular exhaust element 28. Element 28 is a tube which traverses distribution chamber 9 through boreholes 19 and 20 and enters enclosure 10 through borehole 7. At the end cooperating with borehole 20, tube 28 has a flange 22 which ensures leak-tightness and enables it to be connected to an exhaust pipe 29, the outlet of which opens into any point in the secondary flux or into the atmosphere, but always within a reduced-pressure zone.

Figure 3:
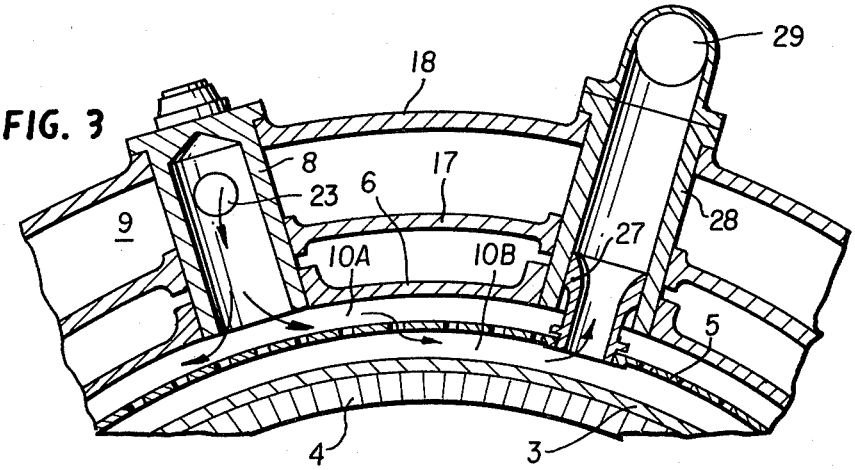
FIG. 3 is a diametrical cross-section of a portion of a turbine which shows the arrangement of a mechanism according to the invention.

FIG. 3 shows the arrangement of the tubular intake and exhaust elements around the turbine ring.

Hot or cold air from a control device (not shown) enters through pipe 24, penetrates distribution chamber 9, then passes through openings 23 in tubular intake element 8 into enclosure 10A where it is divided into jets by perforated partition 5 so as to enter chamber 10B and strike sleeve 3. The air then escapes tangentially from either side of the impact zone up to the exhaust zone, there it passes through nozzle 27 disposed in the perforated partition and through tubular exhaust element 28, next crossing chamber 10A and distribution chamber 9 and, through pipes 29, reaching the zone provided for its escape. The exhaust may be provided in a low-pressure zone or connected to depressurizing mechanism, which would have the consequence of facilitating the transfer of air from chamber 10A to chamber 10B and its recovery through nozzles 27.

The operation of the device for adjusting the clearance between turbine blades and ring is as follows: during acceleration, the turbine disk (which is slow to heat up) expands slowly, while the turbine ring is actively cooled to take up the clearance. At stabilized speed, the expansion of the disk increases and is compensated for by expansion of the ring, for which the cooling air flow is reduced. In deceleration, the ring cools more quickly than the disk. To avoid any risk of contact between the blades and ring, the ring is heated, or more simply, in the case of small jet engines, cooling of the ring is ceased.

Preferentially, in the previously described embodiment, the material for the ring will have a low expansion coefficient, e.g., the alloy sold under the name "Inco 903". The same will be true for the tubular elements. Since the ring is independent of the housing, to which it is connected solely by means of the tubular elements, it will expand totally independently of the housing, which may therefore be constructed of a less noble material than the ring, with the tubular elements ensuring the radial centering of the ring, according to a radiating tube suspension.

Connecting the air distribution chamber and the turbine ring by means of tubular elements give rise to only very small leakages, leading to better control of heat regulation. The escape of regulating air through the tubular elements to the static ventilator or the atmosphere permits low pressure and low temperature intake and thus good cooling with only a slight loss of performance.

The device thereby makes possible the easy use of low pressure, cool air for cooling, including air taken directly from outside. Ejection of that air is done statically, either into the secondary jet, into the atmosphere, or expanded ejection zone.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for adjustment of the clearance between the blades and circumferentially continuous monoblock ring of a turbine, comprising:

an inner sleeve having a seal gasket mounted thereto, a perforated, cylindrical partition encompassing the sleeve and fastened thereto;

a peripheral wall forming a distribution chamber for the air which heats or cools the ring, an opposite wall;

an enclosure formed by said inner sleeve which supports said seal gasket, and said opposite wall; and a plurality of tubular elements radially connecting said enclosure to the distribution chamber and ensuring the passage of heating or cooling air from the distribution chamber to the enclosure, wherein said inner sleeve and partition are circumferentially continuous and wherein said opposite wall has bore holes for receiving one end of the tubular elements, further comprising an exhaust pipe and tubular exhaust elements, each of said exhaust elements further comprising an end opening into the enclosure and including a nozzle operatively associated with an opening provided in the perforated partition, each of said exhaust elements also including an end opening to the outside of the distribution chamber and means for connecting with said exhaust pipe.

2. Device according to claim 1, wherein every other tubular element is used for supplying air to the distribution chamber, with the remaining tubular elements used for exhaust.

3. Device according to claim 1, said distribution chamber comprising two series of spaced, coaxial boreholes, one of which fastens the tubular elements and the other guides the tubular elements, without leakage, in the course of variations in length due to thermic expansion.

4. Device according to claim 3, said distribution chamber further comprising two opposing walls wherein boreholes are provided in said two opposing walls of the distribution chamber.

5. Device according to claim 4, each of said tubular elements further comprising a base and a peripheral rim at one end, with said peripheral rim being operatively associated with the wall of the chamber to hold each of the tubular elements in place.

6. Device according to claim 5, each of said tubular elements including openings formed in a wall traversing the distribution chamber, said openings allowing for the passage of air.

7. Device according to claims 1, 3, 4, 5 or 6, further comprising a pipe connected to said distribution chamber for admitting heating or cooling air.

8. Device according to claims 1, 3, 4, 5 or 6, wherein only the turbine ring and the tubular elements comprise a material having a low expansion coefficient.

* * * * *